United States Patent [19]

Lee et al.

[11] Patent Number: 4,744,013

[45] Date of Patent: May 10, 1988

[54] ILLUMINABLE AND SOUNDABLE BATON

[76] Inventors: Juhon Lee, 5th Fl., No. 11-4, Valley 2, Lane 198, Yuan Tong Road, Chung Ho City, Taipei Hsien; Fon-San Kao, 1st Fl., No. 21, Lane 475, Hsin Ming Road, Nei-Hu District, Taipei City, both of Taiwan

[21] Appl. No.: 27,729

[22] Filed: Mar. 19, 1987

[51] Int. Cl.[4] ..... F21L 15/14

[52] U.S. Cl. ..... 362/109; 362/202; 362/98

[58] Field of Search ..... 362/109, 208, 202

[56] References Cited

U.S. PATENT DOCUMENTS

| | | | |
|---|---|---|---|
| 3,443,085 | 5/1969 | Steltzer et al. | 362/202 |
| 3,622,776 | 11/1971 | Wyrick | 362/202 |
| 4,208,701 | 6/1980 | Schock | 362/202 |
| 4,231,077 | 10/1980 | Joyce et al. | 362/109 |
| 4,546,761 | 10/1985 | McCullough | 362/109 |
| 4,607,747 | 8/1986 | Steiner | 362/98 |

*Primary Examiner*—E. Rollins Cross

*Attorney, Agent, or Firm*—Bacon & Thomas

[57] ABSTRACT

A combined flashlight and whistle baton comprising a telescopic cylinder, a handle portion and a sounder which are detachable for various uses. The telescopic cylinder is composed of more than the transparent sleeving members and connects the handle portion with their corresponding engagement elements. The sounder is formed of a insert chip shape which is inputted into a receiving seat situated on the handle portion and is controlled by a battery to activate a sounder.

1 Claim, 3 Drawing Sheets

ILLUMINABLE AND SOUNDABLE BATON

BACKGROUND OF THE INVENTION

This invention relates to a baton, especially to a combined flashlight and whistle baton which comprises an illuminated transparent telescopic cylinder and a sounder to provide lighting and sounding.

Conventional batons, such as the type generally used by policemen, utilize a bulb installed in a transparent cylinder so as to make the baton visible in the night. But since this construction does not incude any type of whistle or sounder,it is very inconvenient for a policeman to whistle a sounder once an appropriate situation occurs.

Therefore, this invention is intended to provide a baton which includes the functions of both a flashlight and a sounding device, and comprises a telescopic cylinder so that the length of the baton can be shortened for convenience in carrying same. Further, the handle portion of this invention can be detached for use as an ordinarily flashlight to provide an additional function of the baton.

SUMMARY OF THE INVENTION

A primary objective of this invention is to provide a combined flashlight and whistle baton which is detachable to a flashlight and which is lengthwise collapsible so as to be conveniently carried.

Another objective of this invention is to provide a sounder in the form of an insert chip which is engageable with the baton of this invention and which transmits a sounding signal without additional electrical wiring.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
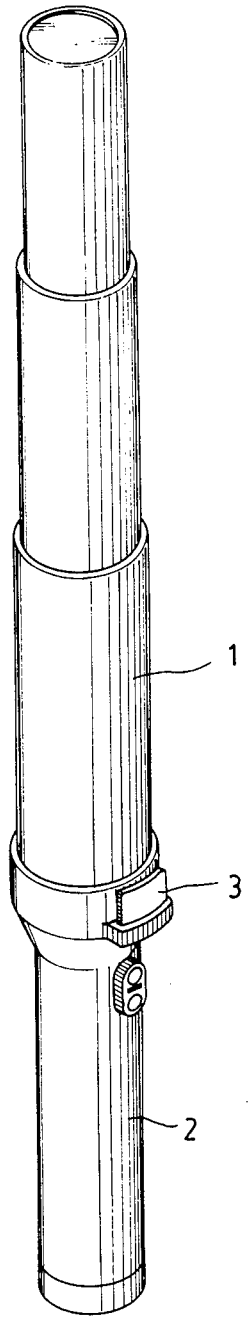
FIG. 1 is a perspective view of this invention.
Figure 2:
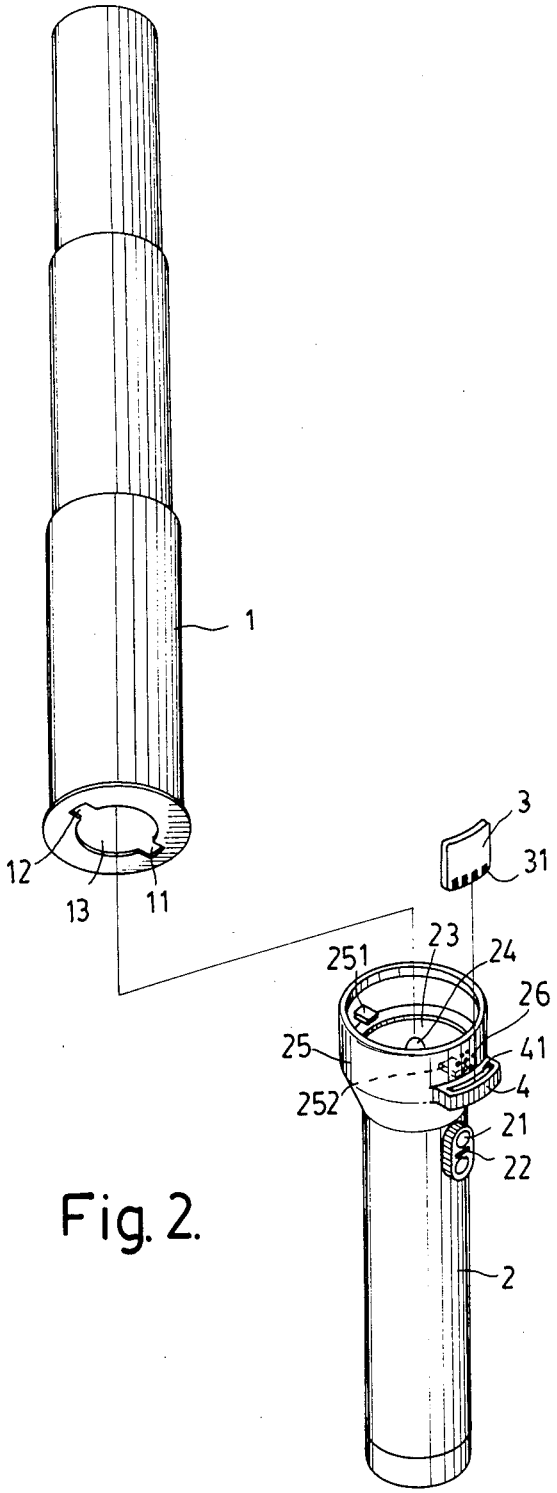
FIG. 2 shows the detachable characteristic of this invention.

Referring to FIGS. 1 and 2, the combined flashlight and whistle baton of the present invention can be seen to comprise a telescopic cylinder 1, a handle portion 2 and a sounder 3. The telescopic cylinder 1 is made of transparent materials and may comprise a plurality of hollow sleeving members. As can be seen in FIG. 2, the telescopic cylinder 1 is detachable from the handle portion 2 by means of the respective corresponding engagement members. On the head of the handle portion 2 a cap 25 is installed which has two protuberances 251 and 252 on the inner rim thereof. These protuberances 251 and 252 are engagable with two corresponding longitudinal recesses 11 and 12 on the edge of a light passing hole 13 of the bottom of the telescopic cylinder 1. After the two pairs of engagement members are engaged, the telescopic cylinder 1 or the handle portion 2 is rotated to prevent the handle portion 2 from slipping off and to secure the telescopic cylinder and the handle portion together.

Figure 3:
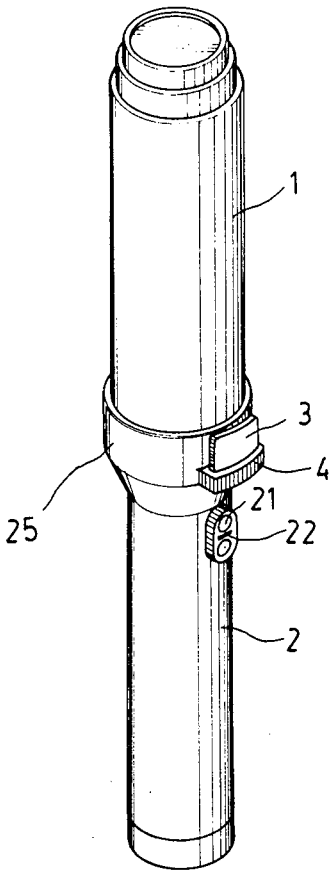
FIG. 3 is a perspective view of this invention with the telescopic portion in a collapsed state.

The telescopic cylinder 1 comprises more than one telescopic sleeving member so that the length of the baton of this invention can be effectively shortened, as shown in FIG. 3, for sake of convenience in carrying.

The handle portion 2, similar to a conventional flashlight, comprises a bulb 24, a cap 25, and a switch 21. A glass 23 covers the bulb 24 and protects it from being broken. As the material of the telescopic cylinder 1 is transparent, the light from the bulb 24 will illuminate the telescopic cylinder 1 so as to permit the baton of the invention to glow in the dark. Further, when the telescopic cylinder 1 is detached from the handle portion 2, the handle portion can be used as a flashlight. The switch 21 activates or deactivates the bulb 24 and the battery providing electrical power is installed in the bottom cavity (not shown) of the handle portion 2.

The baton of this invention further comprises a sounder 3. The sounder 3 is in the form of an insert chip which is received within a receptacle 4 set on the outer edge of the cap 25 and provided with inserting contacts 31 thereof which are electrically conductive with the power source installed in the handle portion 2. Beside the switch 21, there is also a contact switch 22 for controlling the sounder 3. Many holes 26 are bored on the cap 25 adjacent receptacle 4 for transmitting the sound from the sounder 3 into the hollow sleeve members. The sound, after sympathetic vibration of the hollow sleeve members of cyiinder 1, is amplified so as to provide a better sounding function. Further, once the sounder 3 breaks down, it is a simple process to change to another sounder.

According to the above-mentioned description, it is obvious that the combined flashlight and whistle baton of this invention can provide the combined functions of lighting and sounding and it is collapsible for shortening the length thereof for carrying conveniently. Further, the handle portion 2 may be used as a flashlight when the telescopic cylinder 1 is detached.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. An illuminable and soundable baton comprising:

(a) a telescopic cylinder formed of translucent material, the cylinder including a plurality of hollow sleeve members and a bottom, a light hole provided on the bottom of the cylinder, the periphery of the light hole including a pair of opposed recesses;

(b) a handle portion including a head, a substantially annular ring-shaped cap installed on the head of the handle portion, the cap including a pair of opposed protuberances extending inwardly from the inner side of the cap and in a direction perpendicular to the longitudinal axis of the handle portion, the pair of protuberances being configured for engagement within the pair of recesses on the bottom of the cylinder, whereby relative rotation of the cylinder and handle portion permits their detachable engagement;

(c) a bulb covered with glass and installed at the head of the handle portion for lighting up the sleeve members and rendering the cylinder visible;

(d) a receiving seat disposed on the outer side of the cap, with an adjacent corresponding portion of the cap being provided with a plurality of holes;

(e) the handle portion including a bottom cavity, a battery positioned in the bottom cavity and a sounder chip inserted into the receiving seat, the sounder chip being provided with a plurality of contact points on the bottom thereof; and (f) a contact switch installed on the handle portion for controlling conduction of electric current from the battery to the contact points of the sounder chip, whereby when the contact switch is closed, the sounder chip is caused to sound, with the sound being amplified by means of cavity sympathetic vibration through the plurality of holes in the cap.

* * * * *